US011008760B1

(12) United States Patent
Tang

(10) Patent No.: US 11,008,760 B1
(45) Date of Patent: May 18, 2021

(54) PANEL SPLICING STRUCTURE CAPABLE OF REPEATED ASSEMBLY AND DISASSEMBLY WITHOUT DAMAGE AND RAPID SPLICING

(71) Applicant: Lahui Tang, Guangdong (CN)

(72) Inventor: Lahui Tang, Guangdong (CN)

( * ) Notice: Subject to any disclaimer, the term of this patent is extended or adjusted under 35 U.S.C. 154(b) by 0 days.

(21) Appl. No.: 16/750,002

(22) Filed: Jan. 23, 2020

(51) Int. Cl.
*E04F 13/08* (2006.01)

(52) U.S. Cl.
CPC ..... *E04F 13/0862* (2013.01); *E04F 13/0889* (2013.01)

(58) Field of Classification Search
CPC ..... E04F 13/0862; E04F 13/0889; E04B 10/043; E04B 1/12; E04B 1/10; E04B 1/08; E04C 1/24; A63H 33/101; A63H 33/062; A63H 33/107; A63H 33/12; Y10T 403/342; Y10T 403/32581; Y10T 403/553; Y10T 403/55; Y10T 403/555; Y10T 403/59; Y10T 403/599; Y10T 403/60; F16M 11/041; F16B 5/0056; F16B 5/0072; F16B 5/0084; F16B 5/07; F16B 5/004; F16B 5/0032; F16B 5/12; F16B 5/126; F16B 5/128; F16B 12/02; E05B 65/0075; E05B 2009/004; E05B 65/44; E05B 65/003; A47B 47/0025
See application file for complete search history.

(56) References Cited

U.S. PATENT DOCUMENTS 3,786,612 A * 1/1974 Baker ..... F16B 12/40 403/295
4,002,261 A * 1/1977 Litchfield ..... F16B 12/02 220/683
4,036,371 A * 7/1977 Michel ..... F16B 12/02 211/182
4,323,319 A * 4/1982 Adams ..... A47B 47/0008 403/171
4,714,370 A * 12/1987 Chen ..... A47B 47/0008 403/171
4,726,701 A * 2/1988 Thomas ..... F16B 7/0446 403/172
5,112,157 A * 5/1992 Haarer ..... A47H 1/02 211/105.1
5,144,780 A * 9/1992 Gieling ..... E04B 1/5831 135/114
5,363,625 A * 11/1994 Philippi ..... E04B 1/5831 52/653.2

(Continued)

*Primary Examiner* — Theodore V Adamos

(57) ABSTRACT

A panel splicing structure capable of repeated assembly and disassembly without damage and rapid splicing comprises a plurality of panels and a plurality of insertable locking plate structures. The panel is a hollow panel body. The panel is also provided with reinforcing support bars, insertion cavities and locking pin holes. The insertable locking plate structure comprises a hollow plate body, a plurality of locking pins and controlling rods. The locking pins protrude outside or retract inside the sides of the hollow plate body under control of the controlling rods. The panels are arranged side by side with each other. The insertable locking plate structures are inserted into the insertion cavities of the panels, and the locking pins are inserted into the locking pin holes by the controlling rods to assemble the panels to form an integrated panel.

7 Claims, 10 Drawing Sheets

(56) References Cited

U.S. PATENT DOCUMENTS

| | | | | | |
|---|---|---|---|---|---|
| 5,590,974 | A * | 1/1997 | Yang | A47B 47/005 | 403/171 |
| 5,839,248 | A * | 11/1998 | Liang | A47B 47/005 | 52/655.2 |
| 5,904,437 | A * | 5/1999 | Allen | A47B 47/0008 | 403/170 |
| 5,997,117 | A * | 12/1999 | Krietzman | H02B 1/301 | 312/265.4 |
| 6,324,988 | B1 * | 12/2001 | Svensson | B08B 15/002 | 104/89 |
| 6,493,917 | B1 * | 12/2002 | Sunka | A47B 88/994 | 29/413 |
| 8,726,583 | B2 * | 5/2014 | Verdecia | E04H 1/1205 | 52/126.1 |
| 10,889,984 | B2 * | 1/2021 | Arguin | E04B 5/02 | |
| 2004/0109723 | A1 * | 6/2004 | Reynertson, Jr. | B25B 23/0035 | 403/292 |
| 2006/0115324 | A1 * | 6/2006 | Zenda | F16B 7/18 | 403/292 |
| 2007/0175108 | A1 * | 8/2007 | Stein | E04H 1/1205 | 52/79.5 |
| 2010/0084222 | A1 * | 4/2010 | Cleveland | E04G 1/15 | 182/223 |
| 2012/0125870 | A1 * | 5/2012 | Decroos | F16B 7/0406 | 211/26 |
| 2013/0140252 | A1 * | 6/2013 | Murakami | F16B 7/00 | 211/26 |
| 2015/0079451 | A1 * | 3/2015 | Jeong | H01M 2/1077 | 429/151 |
| 2020/0309178 | A1 * | 10/2020 | Wang | A47C 3/16 | |

* cited by examiner

PANEL SPLICING STRUCTURE CAPABLE OF REPEATED ASSEMBLY AND DISASSEMBLY WITHOUT DAMAGE AND RAPID SPLICING

BACKGROUND OF THE INVENTION

The present invention relates to the technical field of integrated panel manufacturing, and more specifically relates to an integrated panel structure formed by splicing.

Currently, aluminum panels, plastics panels or composite panels which are relatively larger in area that are available in the marketplace are formed as follows: Small panels with male fastening edges and female fastening edges are manufactured with molds. These small panels are smaller in width and area, and are therefore beneficial for forming by pressing with molds. When in use, integrated panels with larger width and area are formed by interlocking the male fastening edges and the female fastening edges of the small panels. Integrated panels formed by the aforementioned method have the following disadvantages: As the integrated panels are formed by interconnecting the male fastening edges and the female fastening edges only, when the integrated panels are used on support surfaces without any paving, the integrated panels are easily loosened due to impact of external force, and thus the structural strength and impact resistance of the integrated panels are relatively weak. For example, floor panels, wall panels and so forth with the aforementioned problems could only be applied on flooring and walls with paved support surfaces. However, in reality, there are many circumstances where integrated panels of large area need to be used, and such needs in real life applications could not be fulfilled due to the relatively weak structural strength and impact resistance of the integrated panels of large area with the aforementioned splicing structure. Therefore, the applicant is of the view that it is necessary to completely forgo the current splicing structure and develop a panel splicing structure which can significantly enhance the structural strength and impact resistance of the integrated panel after splicing in order to better fulfill the needs of home construction in future.

BRIEF SUMMARY OF THE INVENTION

In view of the aforesaid disadvantages now present in the prior art, the present invention provides a panel splicing structure capable of repeated assembly and disassembly without damage and rapid splicing which makes use of a plurality of hollow panels and a plurality of insertion locking plate structures which insert into the panels to lock the panels to form an integrated panel; the integrated panels of the present invention are large in terms of area and width, which are not only capable of on-site assembly and repeated assembly and disassembly, but are also possible to attain packaging and transportation of disassembled components, reducing transportation size, increasing convenience of transportation, and saving transportation costs. The integrated panels are formed by splicing the panels and insertion and locking of the insertion locking plate structures, so that the structural strength of different parts and different positions of the integrated panels are equal, thus attaining balanced structural strength and high impact resistance, as well as simple and rapid assembly and splicing.

To attain this, the panel splicing structure capable of repeated assembly and disassembly without damage and rapid splicing of the present invention is characterized in that it comprises a plurality of panels and a plurality of insertable locking plate structures, wherein each of the panels is a hollow panel body with two symmetrical sides which are spatially communicated with each other; the panel has a hollow interior where a plurality of reinforcing support bars are disposed; an insertion cavity for receiving the insertable locking plate structure is formed between two reinforcing support bars in the hollow interior of the panel; locking pin openings are provided on the reinforcing support bar on each of two sides of the insertion cavity; each of the insertable locking plate structures comprises a hollow plate body, a plurality of locking pins disposed on two sides of the hollow plate body, and controlling rods disposed inside the hollow plate body for controlling protrusion or retraction of each of the locking pins; the locking pins protrude outside or retract inside the sides of the hollow plate body under control of the controlling rods respectively; the panels are arranged side by side with each other; the insertable locking plate structures are inserted into the insertion cavities of the panels respectively; by rotating the controlling rods of the insertable locking plate structures respectively, the locking pins of the insertable locking plate structures are inserted into the locking pin openings respectively to lock and assemble the panels to form an integrated large panel body.

Furthermore, a plurality of cone-shaped members are provided on each of the controlling rods; a controlling block is provided at a rear end of each of the locking pins; a return spring is provided between the controlling block and the locking pin; the controlling block is provided with an elongated through hole and a cone-shaped elongated recess adjacent to the elongated through hole; the controlling rod passes through the elongated through hole; the cone-shaped member has a conical tip which abuts against an edge of the cone-shaped elongated recess; two ends of the controlling rod are each provided with a positioning block; one of the positioning blocks is provided with a screw hole, another one of the positioning blocks is provided with a rod hole; one of the two ends of the controlling rod is provided with an external screw threaded connecting portion which screws into the screw hole, another one of the two ends of the controlling rod is provided with an internal hex socket and inserts into the rod hole.

The present invention has the following beneficial advantages: The present invention makes use of a plurality of hollow panels and a plurality of insertion locking plate structures which insert into the panels to lock the panels to form an integrated panel, resulting in integrated panels which are large in terms of width and area. The controlling rods of the insertion locking plate structures are used to control the locking pins to protrude into or retract from the locking pin holes, thereby attaining locking and unlocking of the panels, and furthermore allowing the integrated panels to be assembled and disassembled on-site. Besides, such assembly and disassembly uses the same sets of locking pins and locking pin holes, and thus the integrated panels could be repeatedly assembled and disassembled without damage. Furthermore, when the manufacturers deliver the products, it is possible to package and transport the disassembled components and the disassembled components could be assembled on-site for use, therefore significantly reducing transportation size of the integrated panels, enhancing convenience of transportation and saving transportation costs. Moreover, the integrated panels are formed by splicing the panels and insertion and locking of the insertion locking plate structures, so that the structural strength of different parts and different positions of the integrated panels are equal, resulting in balanced structural strength, high impact resistance, and high durability and reliability. Besides, as the integrated panels are formed by splicing panels of the same structure, the molds required for manufacturing are only one panel mold for die casting of the panels and the molds required for manufacturing the insertion locking plate structures; the specifications and numbers of the molds are very limited, which is advantageous for saving manufacturing costs, enhancing manufacturing efficiency, and increasing market competitiveness of the products. The present invention can be used for manufacturing of aluminum, plastic or composite integrated panels which are large in area and width, and also used directly in manufacturing of doors, furniture, walls, flooring, transportable housing, car bodies and so forth.

DETAILED DESCRIPTION OF THE INVENTION

Figure 1:
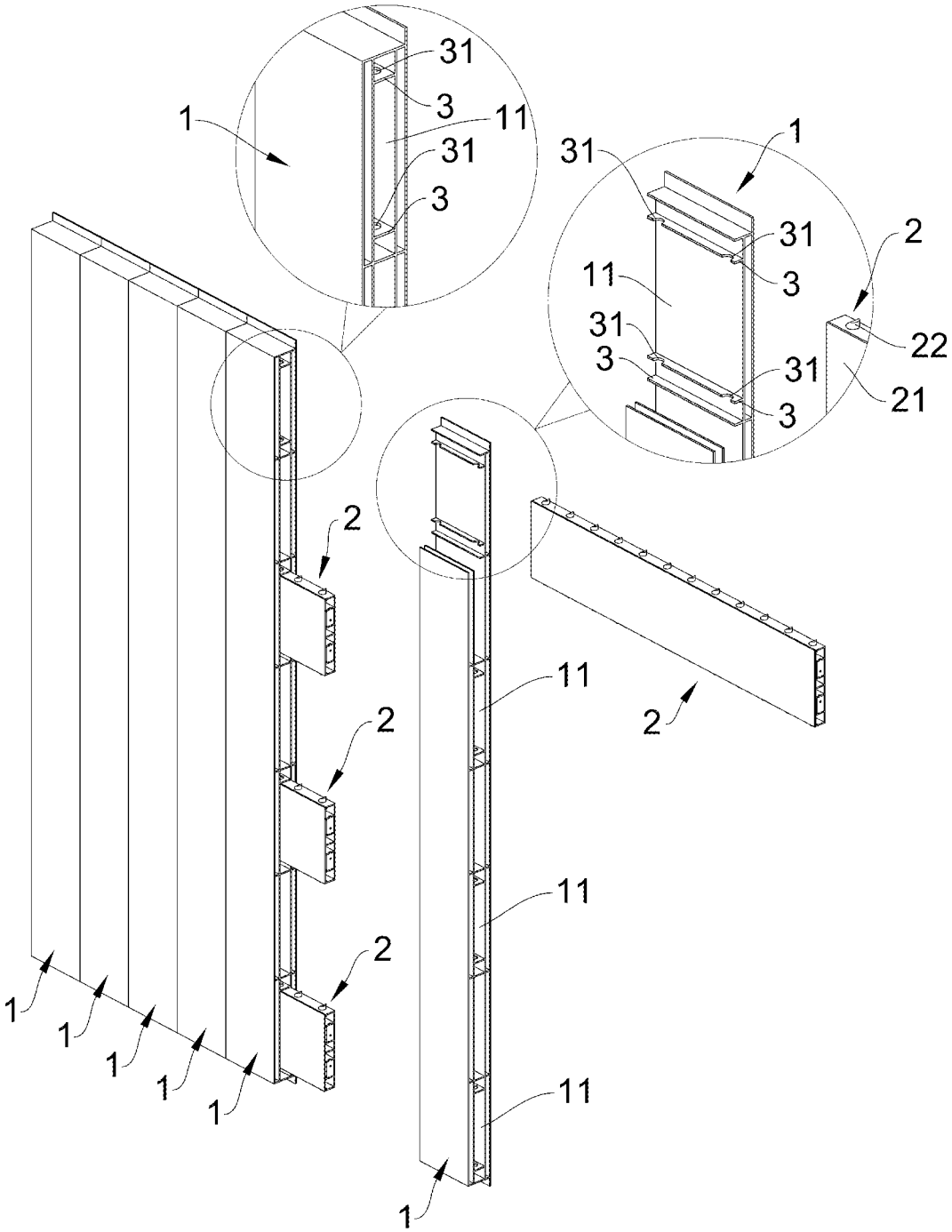
FIG. 1 shows a perspective structural view of the present invention in disassembled condition.

As illustrated in FIG. 1, the panel splicing structure which is capable of repeated assembly and disassembly without damage and rapid splicing of the present invention comprises a plurality of panels 1 and a plurality of insertable locking plate structures 2. Each of the panels 1 is a hollow panel body with two symmetrical sides which are spatially communicated with each other. The panel 1 has a hollow interior where a plurality of reinforcing support bars 3 are disposed. An insertion cavity 11 for receiving the insertable locking plate structure 2 is formed between two reinforcing support bars 3 in the hollow interior of the panel 1. Locking pin openings 31 are provided on the reinforcing support bar 3 on each of the two sides of the insertion cavity 11, as illustrated at the top right corner of FIG. 1.

Figure 2:
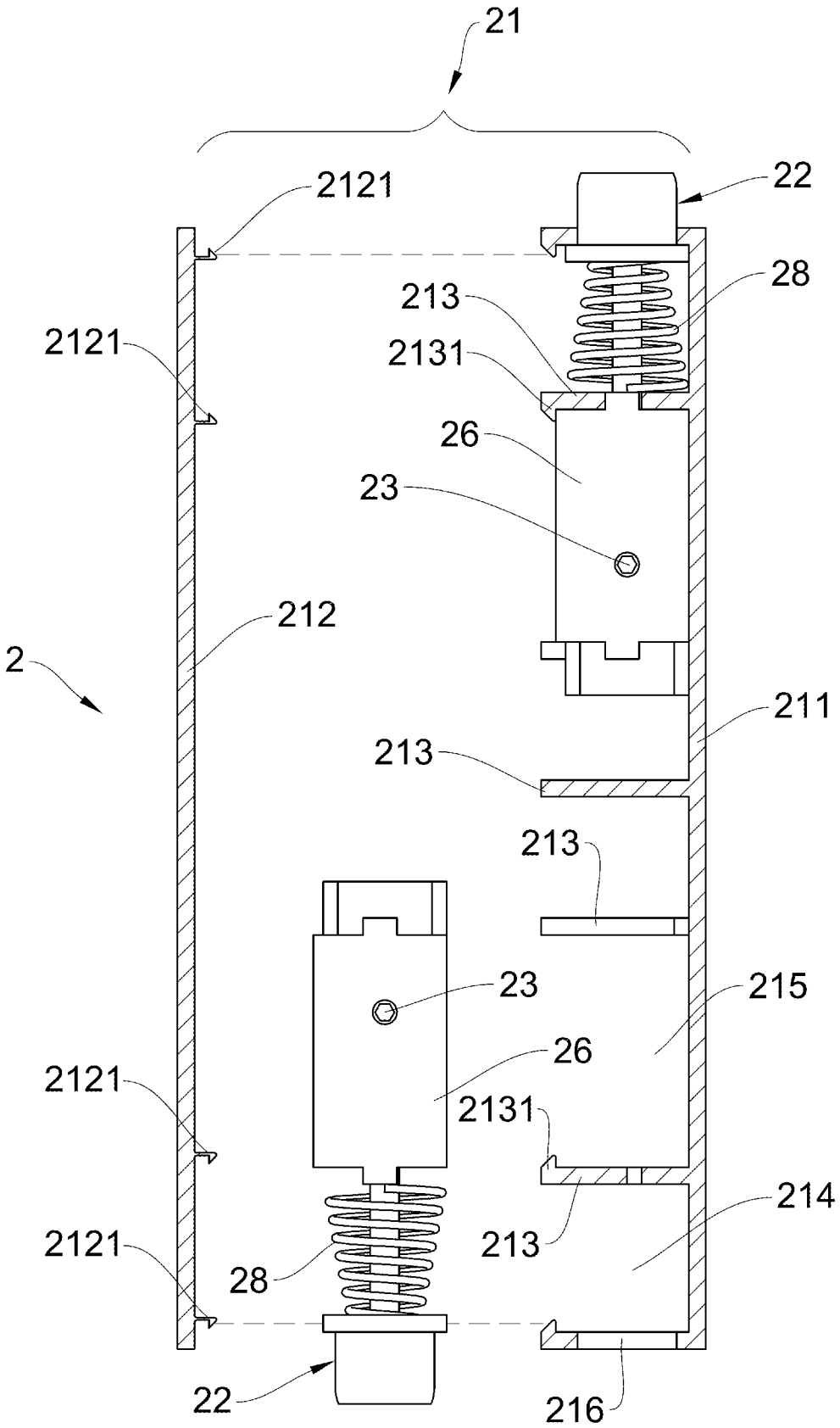
FIG. 2 shows a sectional view of the end structure of the insertion locking plate structure of the present invention in disassembled condition.
Figure 3:
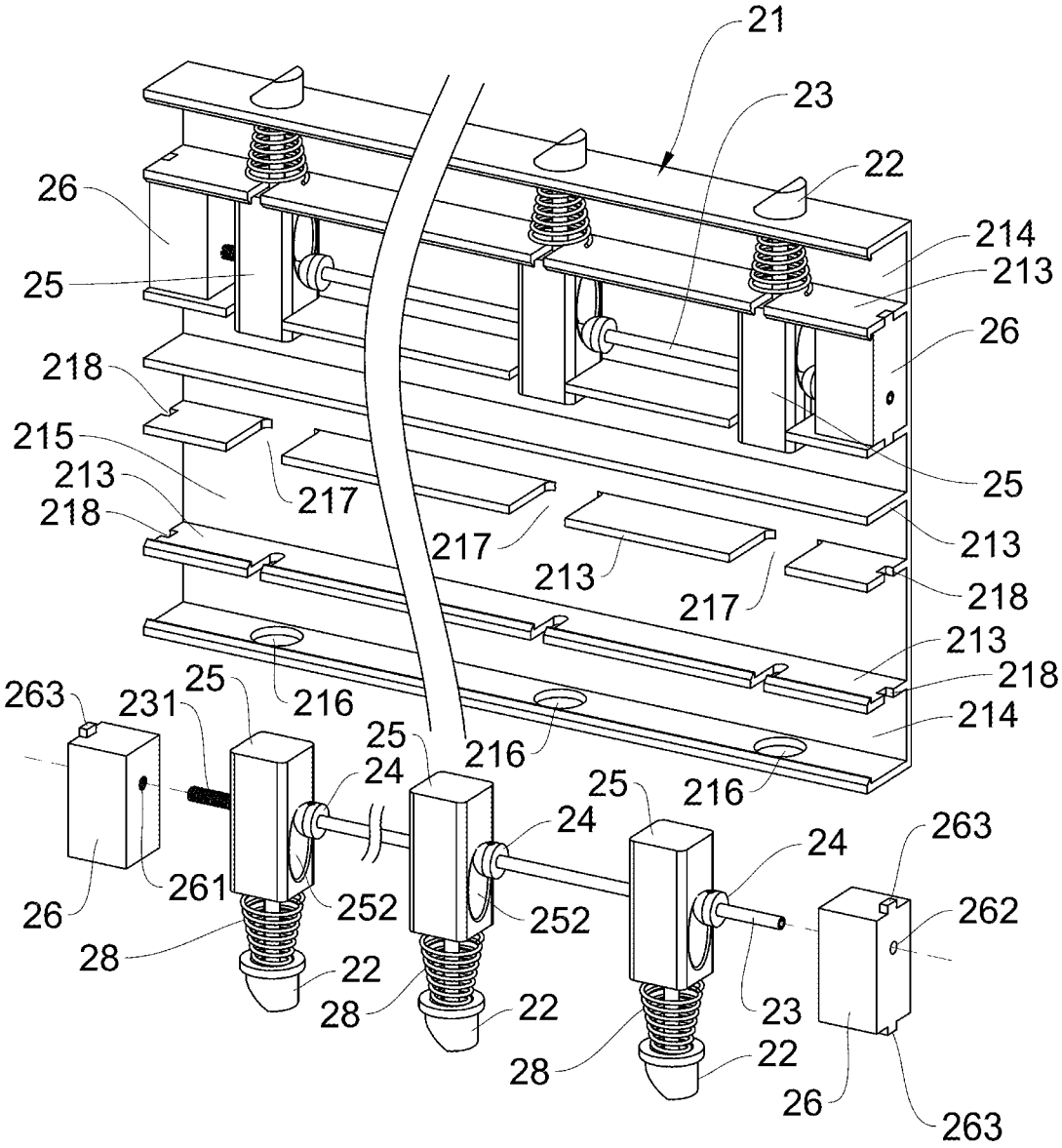
FIG. 3 shows a disassembling structural view of the insertion locking plate structure of the present invention after removal of the cover board.
Figure 4:
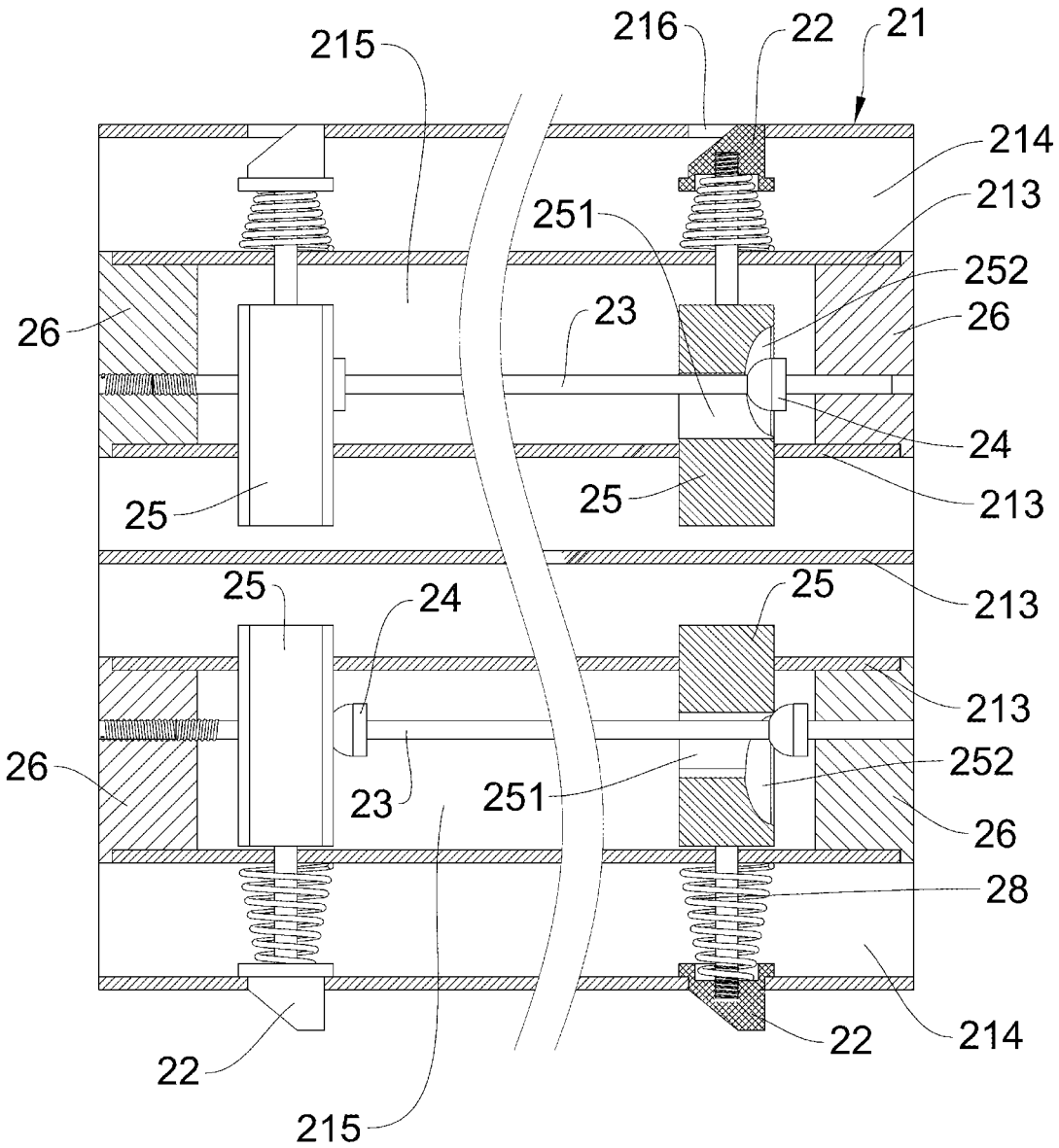
FIG. 4 shows a sectional view of the insertion locking plate structure of the present invention along a vertical direction.

As illustrated in FIGS. 2-4, each of the insertable locking plate structures 2 comprises a hollow plate body 21, a plurality of locking pins 22 disposed on two sides of the hollow plate body 21, and controlling rods 23 disposed inside the hollow plate body 21 for controlling protrusion or retraction of each of the locking pins 22. The locking pins 22 protrude outside the sides of the hollow plate body 21 under the control of the controlling rods 23 respectively to lock the panels 3 together, as illustrated at the lower portion of FIG. 4. Alternatively, in an unlocked state, the locking pins 22 retract inside the sides of the hollow plate body 21 under the control of the controlling rods 23 respectively, as illustrated at the upper portion of FIG. 4. In the unlocked state, each of the insertable locking plate structures 2 can be inserted into the insertion cavity 11 of each of the panels 1.

As illustrated in FIG. 1, the panels 1 are arranged side by side with each other, and the insertable locking plate structures 2 are inserted into the insertion cavities 11 of the panels 1 respectively. By rotating the controlling rods 23 of the insertable locking plate structures 2 respectively, the locking pins 22 of the insertable locking plate structures are inserted into the locking pin openings 31 respectively to lock and assemble the panels 1 to form an integrated large panel body, as shown at the left side of FIG. 1.

To attain the advantages of simplicity, easy implementation and secured locking for the insertable locking plate structure 2, as illustrated in FIGS. 2 to 4, a plurality of cone-shaped members 24 are provided on the controlling rod 23. A controlling block 25 is provided at a rear end of the locking pin 22. A return spring 28 is provided between the controlling block 25 and the locking pin 22. The controlling block 25 is provided with an elongated through hole 251 and a cone-shaped elongated recess 252 adjacent to the elongated through hole 251. The controlling rod 23 passes through the elongated through hole 251. The cone-shaped member 24 has a conical tip 241 which abuts against an edge of the cone-shaped elongated recess 252. Two ends of the controlling rod 23 are each provided with a positioning block 26. One of the positioning blocks 26 is provided with a screw hole 261, another one of the positioning blocks 26 is provided with a rod hole 262. One of the two ends of the controlling rod 23 is provided with an external screw threaded connecting portion 231 which screws into the screw hole 261, another one of the two ends of the controlling rod 23 is provided with an internal hex socket 232 and inserts into the rod hole 262.

As illustrated at the top left corner of FIG. 4, when a hex key is used to turn the internal hex socket 232 to drive the controlling rod 23 to rotate, and when the conical tip 241 of the cone-shaped member 24 slides to the bottom of the cone-shaped elongated recess 252, the controlling block 251 is driven to move forward for a relatively long distance, thereby retracting the locking pin 22 into the hollow plate body 21. In contrast, as illustrated at lower right corner of FIG. 4, when the conical tip 241 of the cone-shaped member 24 slides to the edge of the cone-shaped elongated recess 252, the controlling block 25 is driven to move backward for a relatively long distance, and the locking pin 22 protrudes outwards from an external side of the hollow plate body 21 under the action of the return spring 28. The movement of the locking pin 22 is driven by the combination of the screw rotation structure and the horizontal movement of the cone-shaped member which achieves transition from rotational to horizontal movement, so that when the locking pin 22 is under the action of external force, such external force would not covert into a force which causes rotation of the controlling rod 23, thereby attaining secured locking. Besides, as the locking pin 22 is only responsible for inserting into the locking pin opening 41 to achieve horizontal positioning while the hollow plate body 21 performs insertion and positioning on the panels 1, the locking pin 22 basically is subject to zero external force at the vertical direction, so that the locking pin 22 could securely lock the panels 1 without self-disassembly or self-loosening.

Figure 5:
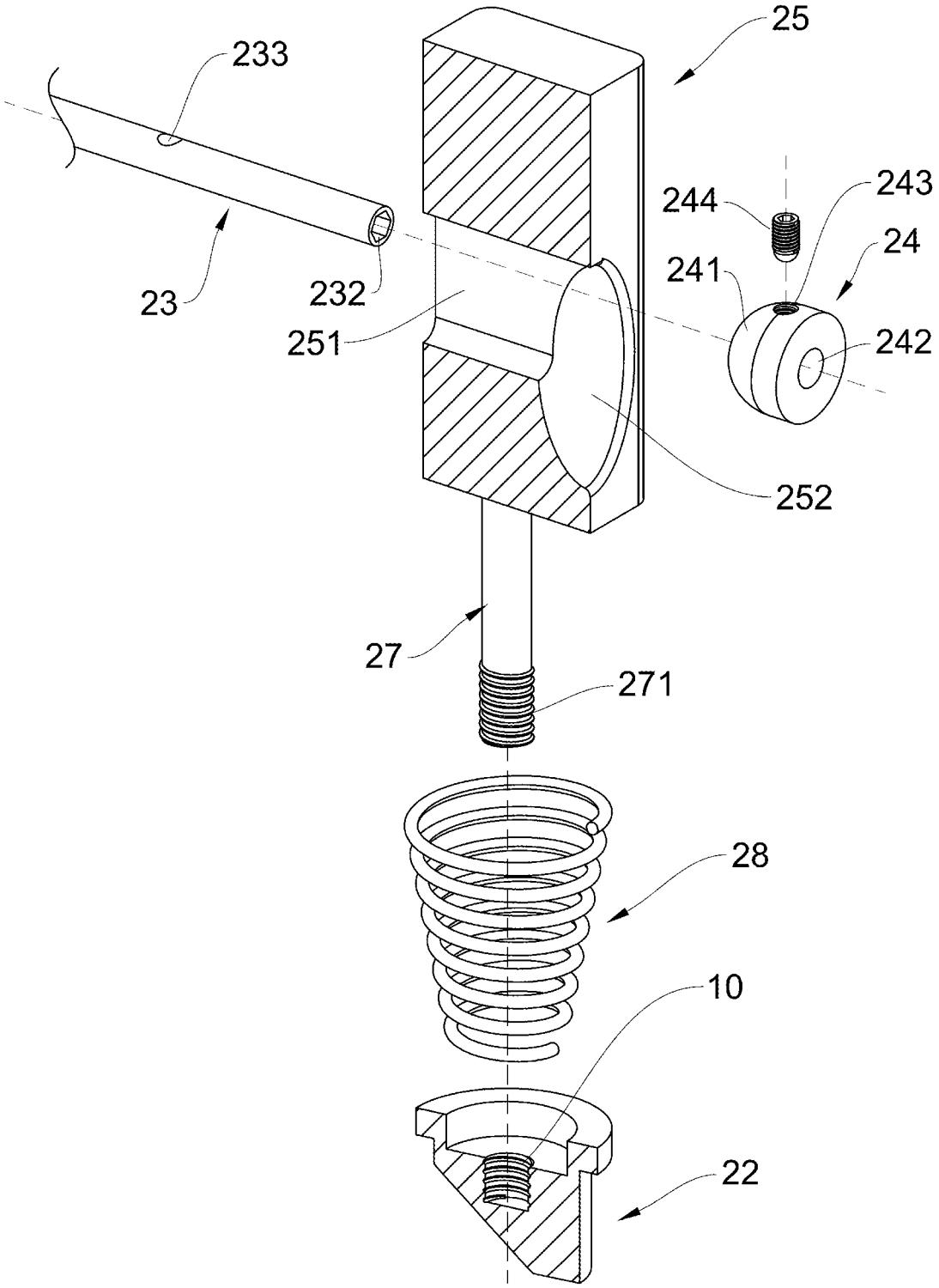
FIG. 5 shows a disassembling structural view of the locking pin structure of the present invention.

To enable the cone-shaped member 24 to mount on the controlling rod 23 in a simple and reliable manner and to be manufactured easily, as illustrated in FIG. 5, the cone-shaped member 24 has an insertion hole 242 which perforates from an end face of the cone-shaped member 24 through the entire cone-shaped member 24. A fixing screw hole 243 which penetrates to the insertion hole 242 is provided on a side of the cone-shaped member 24. A fixing recess 233 is correspondingly provided on a surface of the controlling rod 23. The cone-shaped member 24 is inserted to the controlling rod 23 via the insertion hole 242, and a countersunk head screw 244 having an internal hex socket is screwed to the fixing recess 233 via the fixing screw hole 243, so that the cone-shaped member 24 is fixedly mounted on the controlling rod 23.

To further optimize the assembly structure of the insertion positioning plate structure 2 to make it more convenient to process and assemble, as illustrated in FIGS. 2 to 4, the hollow plate body 21 comprises a base board 211 with a recessed cavity and a cover board 212. A plurality of partitioning boards 213 are integrally formed in the recessed cavity of the base board 211. Locking pin cavities 214 are formed at outermost positions of the recessed cavity of the base board 211. A plurality of pin holes 216 which penetrate to the locking pin cavities 214 are provided on two sides of the base board 211. The locking pins 22 lie horizontally and laterally across the locking pin cavities 214. A front end of the locking pin 22 inserts in the pin hole 216, as illustrated in FIGS. 3 and 4. Furthermore, controlling block cavities 215 are formed in the recessed cavity of the base board 211 adjacent to the locking pin cavities 214. Horizontally limiting slots 217 are formed on the controlling block cavities 215. The controlling blocks 25 lie horizontally and laterally across the controlling block cavities 215. Rear ends of the controlling blocks 25 are embedded in the horizontally limiting slots 217. A connecting rod 27 is connected between a front end of the controlling block 25 and a rear end of the locking pin 22. The connecting rod 27 lies across and between the locking pin cavity 214 and the controlling block cavity 215. The return spring 28 is sleeved on the connecting rod 27. A first end of the return spring 28 abuts against the rear end of the locking pin 22. A second end of the return spring 28 abuts against a wall of the locking pin cavity 214.

To allow the base board 211 and the cover board 212 to be assembled together in a simple and effective manner, as illustrated in FIG. 2, the partitioning boards 213 of the base board 211 are disposed with inward-facing hooks 2131. An inner side of the cover board 212 disposed with outward-facing hooks 2121 which correspond with the inward-facing hooks. The cover board 212 assembles with the base board 211 by the interlocking between the outward-facing hooks 2121 and the inward-facing hooks 2131.

Besides, to allow the positioning block 26 to be mounted between the end faces of the base board 211 and the cover board 212, as illustrated in FIG. 3, the partitioning boards 213 between the end faces of the base board 211 and the cover board 212 are each provided with a notch 218. The positioning block 26 is correspondingly provided with protrusions 263. The positioning block 26 is mounted between the end faces of the base board 211 and the cover board 212 by the interconnection between the protrusions 263 and the notches 218, as illustrated in FIG. 3.

Figure 6:
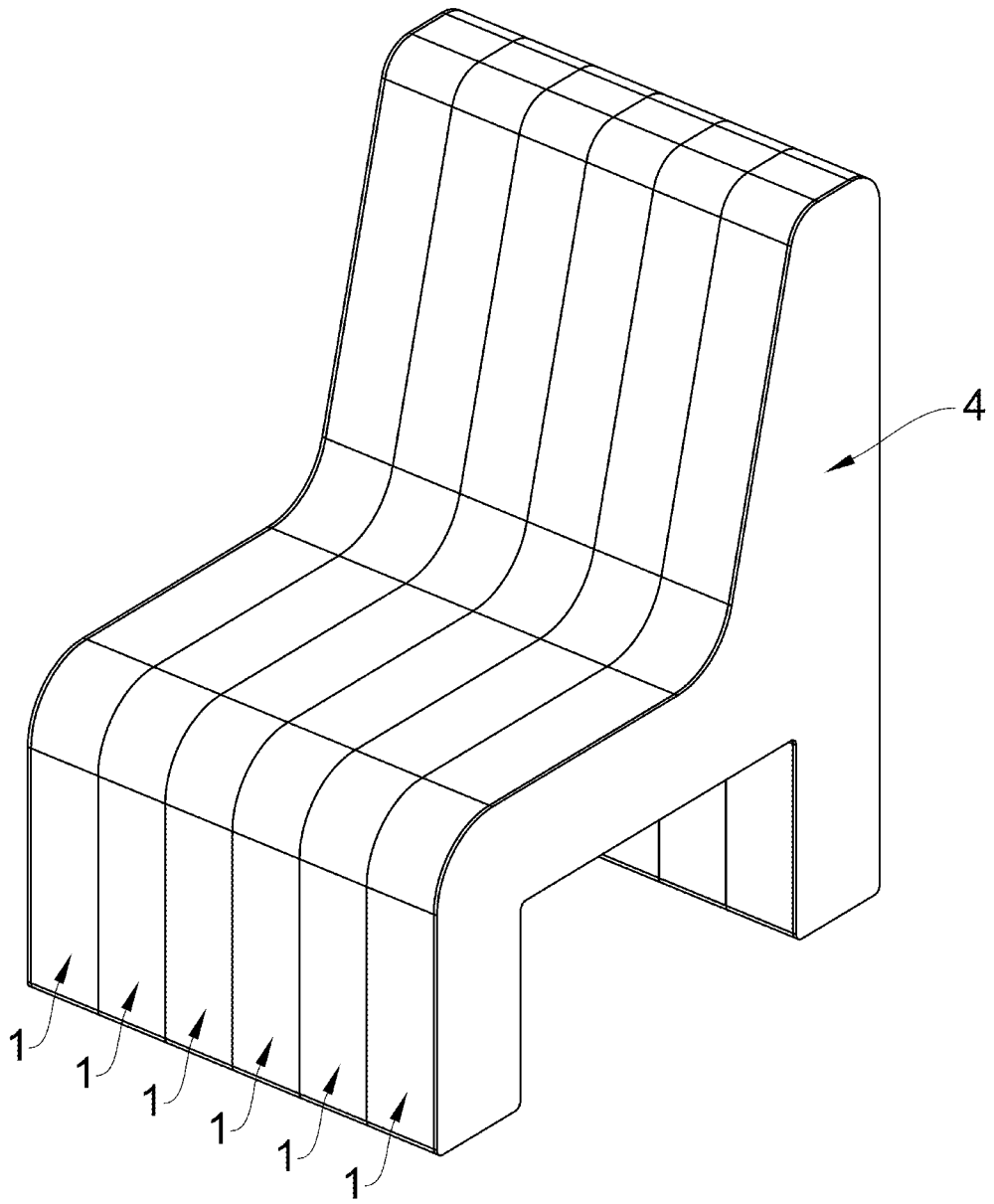
FIG. 6 shows an exemplary view of the present invention as applied in the manufacture of chair.
Figure 7:
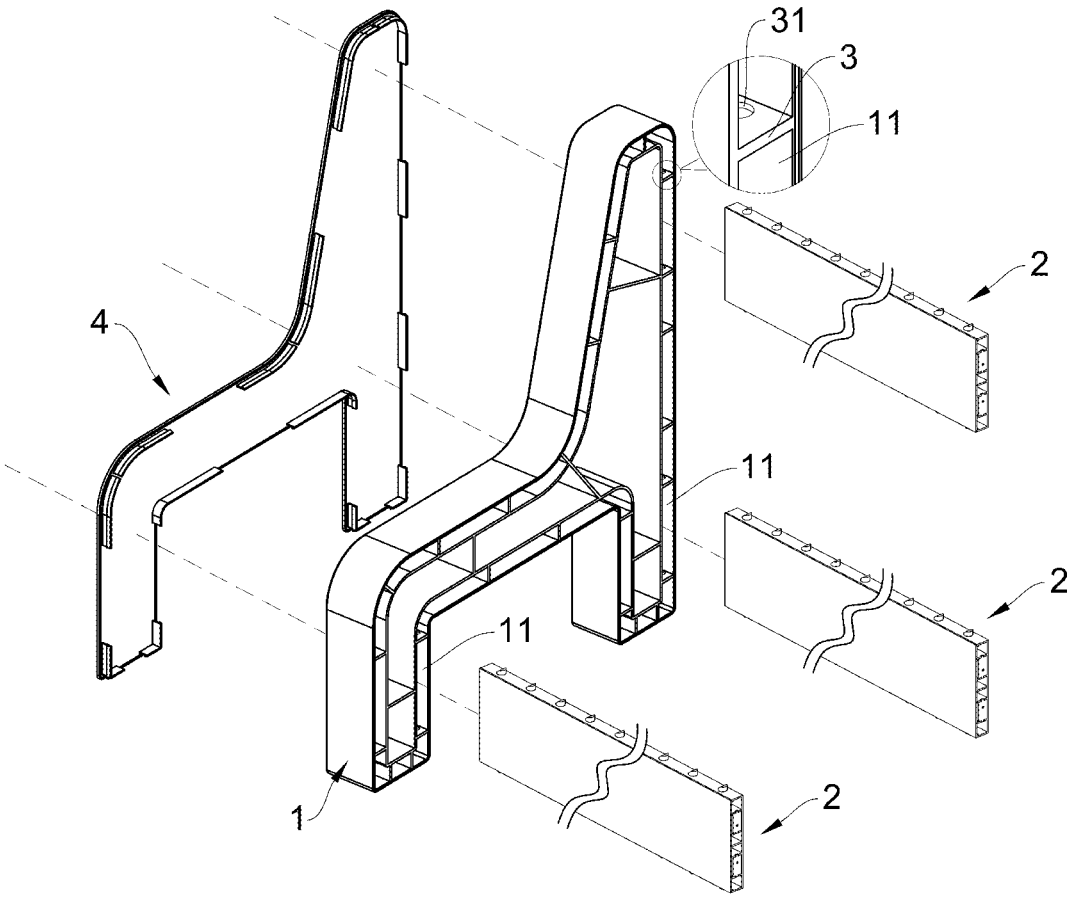
FIG. 7 shows a disassembling view of the embodiment as shown in FIG. 6.
Figure 8:
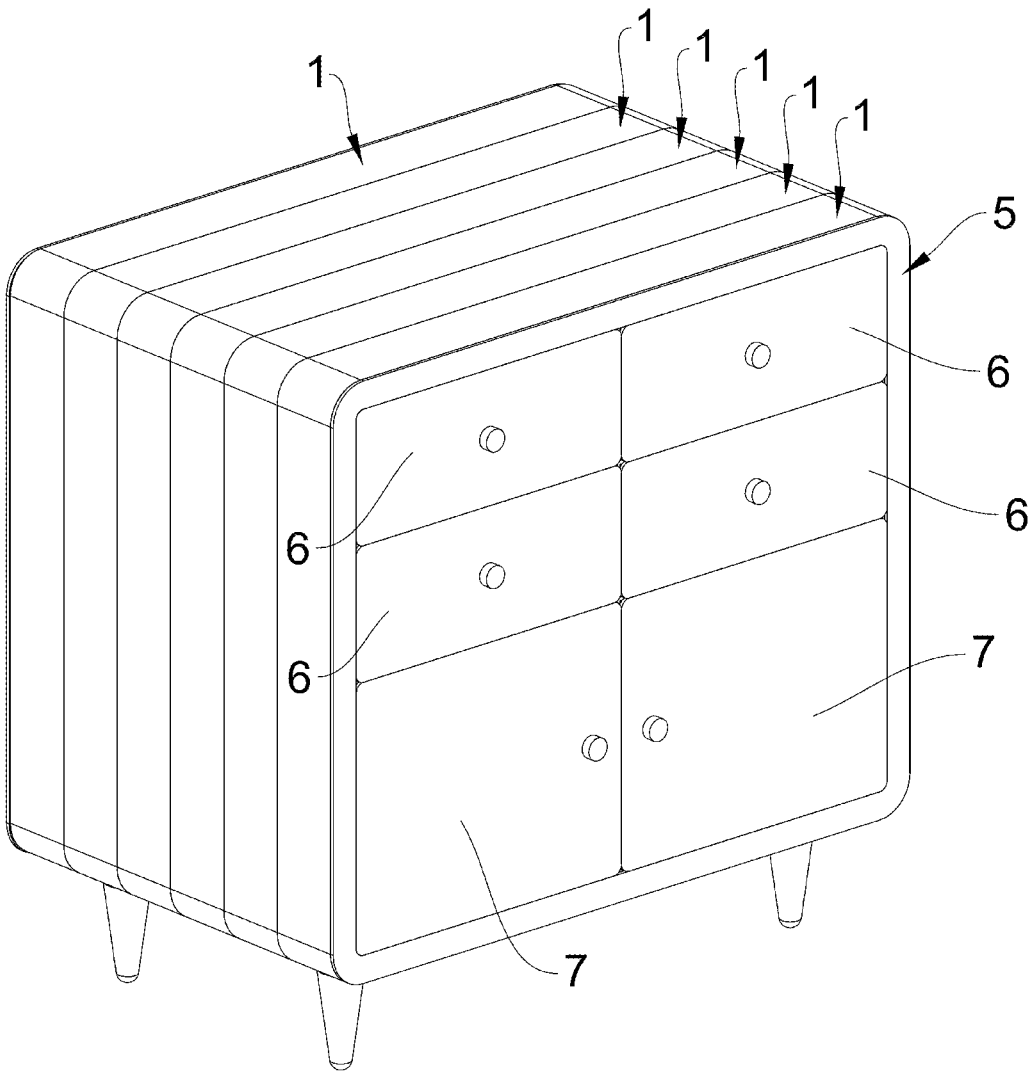
FIG. 8 shows an exemplary view of the present invention as applied in the manufacture of cabinet.
Figure 9:
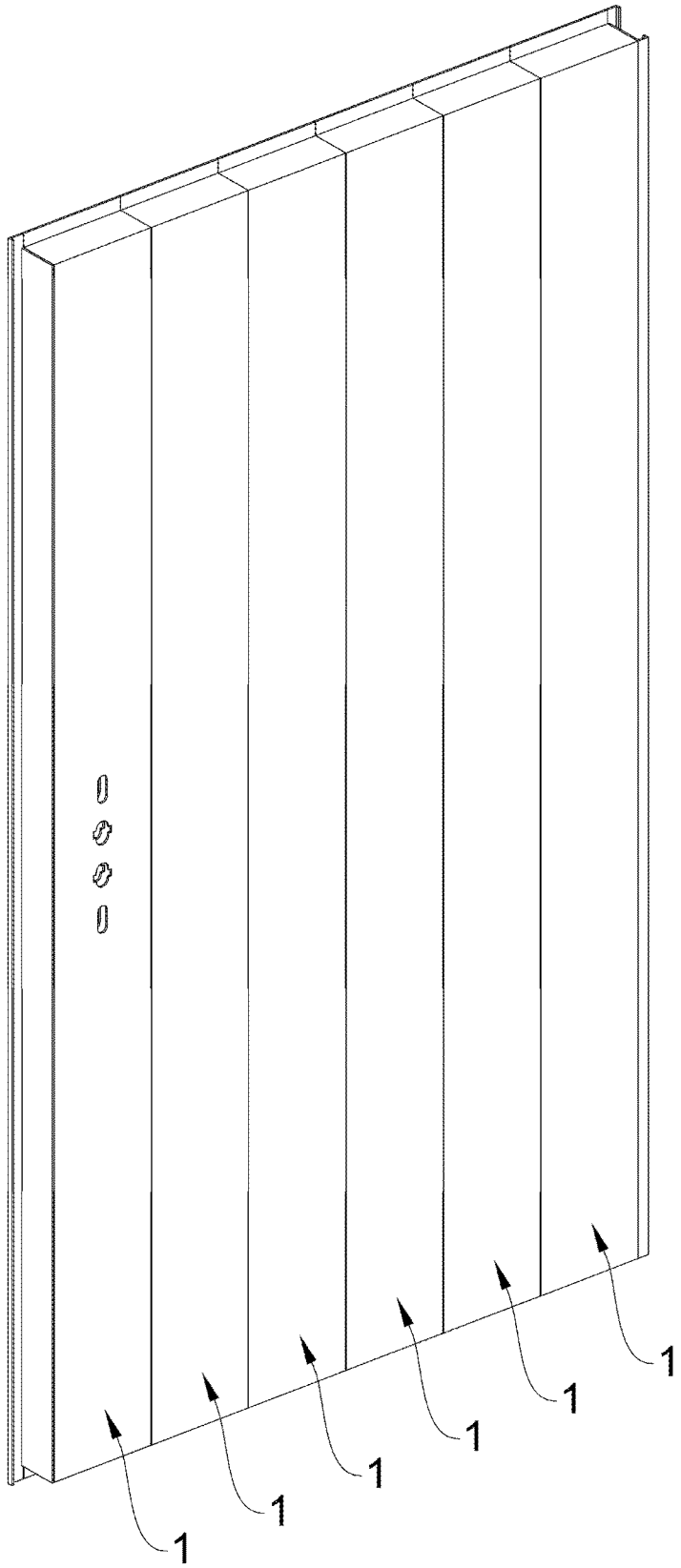
FIG. 9 shows an exemplary view of the present invention as applied in the manufacture of door.
Figure 10:
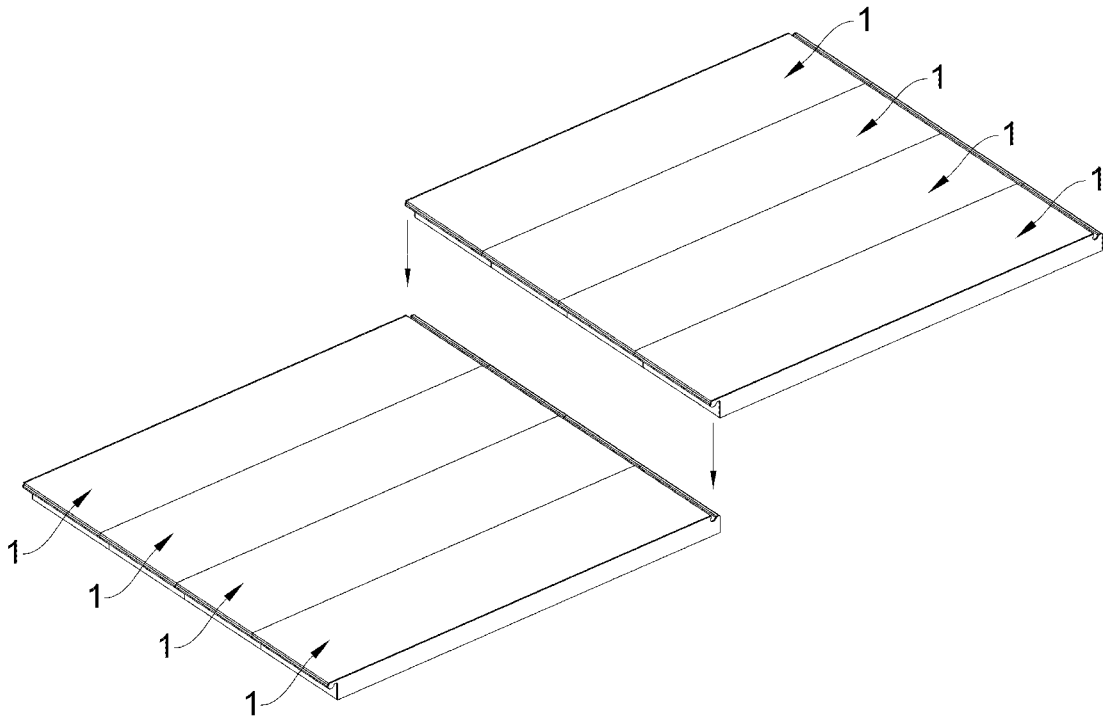
FIG. 10 shows an exemplary view of the present invention as applied in the manufacture of flooring.

The present invention may be used for manufacturing a variety of construction materials or household products. For example, as illustrated in FIGS. 6 and 7, the panels 1 are prefabricated in an irregular shape for assembling into a chair by splicing. At this time, to make two ends of the chair to be more aesthetically pleasing, it is normally required to prefabricate an irregular shaped end board 4 for fastening on each of the two ends of the chair so as to conceal the internal structures and resulting a more tidy and pleasant outlook. Furthermore, as illustrated in FIG. 8, by manufacturing the panel 1 into a shape resembling a squared frame, it is possible to assemble a cabinet by splicing with a splicing method similar to that as illustrated in FIGS. 1 and 7. At this time, at the back of the cabinet, it is necessary to provide a back board; at the periphery of the front end of the cabinet, it is also necessary to provide an annular guarding edge 5. At the front end face of the cabinet, drawers 6, doors 7 and so forth may be provided based on needs. Support legs 8 and so forth may also be provided at the bottom of the cabinet. Similarly, as illustrated in FIG. 9, it is possible to assemble a door by splicing, or as illustrated in FIG. 10, it is possible to assemble a flooring by splicing.

The above description conveys a preferred embodiment of the present invention, but it does not limit the scope of protection of the present invention. It should be noted that, to a person skilled in the art, other variations and improvements not deviating from the spirit of the present invention belong to the protection scope of the present invention and fall within the scope of protection of the present invention.

What is claimed is:

1. A panel splicing structure capable of repeated assembly and disassembly without damage and rapid splicing comprises a plurality of panels and a plurality of insertable locking plate structures, wherein:

each of the panels is a hollow panel body with two symmetrical sides which are spatially communicated with each other; the panel has a hollow interior where a plurality of reinforcing support bars are disposed; an insertion cavity for receiving the insertable locking plate structure is formed between two reinforcing support bars in the hollow interior of the panel; locking pin openings are provided on the reinforcing support bar on each of two sides of the insertion cavity;

each of the insertable locking plate structures comprises a hollow plate body, a plurality of locking pins disposed on two sides of the hollow plate body, and controlling rods disposed inside the hollow plate body for controlling protrusion or retraction of each of the locking pins; the locking pins protrude outside or retract inside the sides of the hollow plate body under control of the controlling rods respectively;

the panels are arranged side by side with each other; the insertable locking plate structures are inserted into the insertion cavities of the panels respectively; by rotating the controlling rods of the insertable locking plate structures respectively, the locking pins of the insertable locking plate structures are inserted into the locking pin openings respectively to lock and assemble the panels to form an integrated large panel body.

2. The panel splicing structure capable of repeated assembly and disassembly without damage and rapid splicing as in claim 1, characterized in that: a plurality of cone-shaped members are provided on each of the controlling rods; a controlling block is provided at a rear end of each of the locking pins; a return spring is provided between each respective controlling block and locking pin; each controlling block is provided with an elongated through hole and a cone-shaped elongated recess adjacent to the elongated through hole; each controlling rod passes through respective elongated through holes; each cone-shaped member has a conical tip which abuts against an edge of a respective cone-shaped elongated recess; two ends of each controlling rod are each provided with a positioning block; one of the positioning blocks is provided with a screw hole, another one of the positioning blocks is provided with a rod hole;

one of the two ends of each controlling rod is provided with an external screw threaded connecting portion which screws into the screw hole, another one of the two ends of each controlling rod is provided with an internal hex socket and inserts into the rod hole.

3. The panel splicing structure capable of repeated assembly and disassembly without damage and rapid splicing as in claim 2, characterized in that: each hollow plate body comprises a base board with a recessed cavity and a cover board; a plurality of partitioning boards are integrally formed in the recessed cavity of the base board; locking pin cavities are formed at outermost positions of the recessed cavity of the base board; a plurality of pin holes which penetrate to the locking pin cavities are provided on two sides of the base board; the locking pins lie horizontally and laterally across the locking pin cavities; a front end of each locking pin inserts in a respective pin hole.

4. The panel splicing structure capable of repeated assembly and disassembly without damage and rapid splicing as in claim 3, characterized in that: controlling block cavities are formed in the recessed cavity of the base board adjacent to the locking pin cavities; horizontally limiting slots are formed on the controlling block cavities; the controlling blocks lie horizontally and laterally across the controlling block cavities; rear ends of the controlling blocks are embedded in the horizontally limiting slots; a connecting rod is connected between a front end of each controlling block and a rear end of each locking pin, respectively; each connecting rod lies across and between each respective locking pin cavity and controlling block cavity.

5. The panel splicing structure capable of repeated assembly and disassembly without damage and rapid splicing as in claim 4, characterized in that: each return spring is sleeved on a respective connecting rod; a first end of each return spring abuts against the rear end of a respective locking pin; a second end of each return spring abuts against a wall of a respective locking pin cavity.

6. The panel splicing structure capable of repeated assembly and disassembly without damage and rapid splicing as in claim 3, characterized in that: the partitioning boards of the base board are disposed with inward-facing hooks; an inner side of the cover board is disposed with outward-facing hooks which correspond with the inward-facing hooks; the cover board assembles with the base board by interlocking between the outward-facing hooks and the inward-facing hooks.

7. The panel splicing structure capable of repeated assembly and disassembly without damage and rapid splicing as in claim 3, characterized in that: the partitioning boards between end faces of the base board and the cover board are each provided with a notch; the positioning block is corresponding provided with protrusions; the positioning block is mounted between the end faces of the base board and the cover board by interconnection between the protrusions and the notches.

* * * * *